US010096249B2

(12) United States Patent
Tan et al.

(10) Patent No.: US 10,096,249 B2
(45) Date of Patent: Oct. 9, 2018

(54) METHOD, APPARATUS AND STORAGE MEDIUM FOR PROVIDING COLLISION ALERT

(71) Applicant: Xiaomi Inc., Beijing (CN)

(72) Inventors: Kangxi Tan, Beijing (CN); Xin Liang, Beijing (CN); Xingmin Wang, Beijing (CN)

(73) Assignee: Xiaomi Inc., Beijing (CN)

( * ) Notice: Subject to any disclaimer, the term of this patent is extended or adjusted under 35 U.S.C. 154(b) by 50 days.

(21) Appl. No.: 15/262,717

(22) Filed: Sep. 12, 2016

(65) Prior Publication Data

US 2017/0116860 A1 Apr. 27, 2017

(30) Foreign Application Priority Data

Oct. 22, 2015 (CN) ..... 2015 1 0695152

(51) Int. Cl.

*G08G 1/16* (2006.01)
*G08G 1/0968* (2006.01)
*G08G 1/133* (2006.01)

(52) U.S. Cl.

CPC ..... *G08G 1/162* (2013.01); *G08G 1/096883* (2013.01); *G08G 1/133* (2013.01); *G08G 1/166* (2013.01)

(58) Field of Classification Search

CPC .. G08G 1/096883; G08G 1/133; G08G 1/162; G08G 1/166; B60W 2050/0062; B60W 2520/10; B60W 2520/105; B60W 2550/10; B60W 2550/146; B60W 2550/30; B60W 30/09; B60W 30/095; B60W 30/0956; B60W 30/18145; B60W 50/14

See application file for complete search history.

(56) References Cited

U.S. PATENT DOCUMENTS 6,707,391 B1 3/2004 Monroe
2010/0019891 A1* 1/2010 Mudalige ..... G08G 1/163 340/425.5
2012/0299713 A1* 11/2012 Elia ..... B60W 30/0956 340/435
2014/0350785 A1 11/2014 Tsuchida
(Continued)

FOREIGN PATENT DOCUMENTS

CN 103578294 A 2/2014
CN 104200688 12/2014
(Continued)

OTHER PUBLICATIONS

International Search Report for International Application No. PCT/CN2015/099727, dated Jul. 22, 2016, 5 pages.
(Continued)

*Primary Examiner* — Sisay Yacob
(74) *Attorney, Agent, or Firm* — Finnegan, Henderson, Farabow, Garrett & Dunner LLP

(57) ABSTRACT

A method for providing a collision alert is provided. The method includes: receiving position information of one or more vehicles; determining, based on the position information and road information, that a vehicle is about to encounter another vehicle at a curve; and providing the collision alert to the vehicle indicating a potential collision at the curve.

17 Claims, 10 Drawing Sheets

(56) References Cited

U.S. PATENT DOCUMENTS

| | | | | |
|---|---|---|---|---|
| 2015/0274072 | A1* | 10/2015 | Croteau | E21F 11/00 340/903 |
| 2016/0071417 | A1* | 3/2016 | Lewis | G08G 1/162 701/301 |
| 2016/0207534 | A1* | 7/2016 | Nishimura | B60W 50/14 |

FOREIGN PATENT DOCUMENTS

| | | | |
|---|---|---|---|
| CN | 204066421 | U | 12/2014 |
| CN | 104376735 | | 2/2015 |
| CN | 204137024 | U | 2/2015 |
| CN | 104392621 | | 3/2015 |
| CN | 104680841 | | 6/2015 |
| CN | 104809916 | A | 7/2015 |
| EP | 3048022 | A1 | 7/2016 |
| JP | 11-053695 | A | 2/1999 |
| JP | 2008129817 | A | 6/2008 |
| JP | 2013077070 | A | 4/2013 |
| JP | 2016132374 | A | 7/2016 |
| RU | 2543123 | C2 | 2/2015 |
| WO | WO 2013/187828 | A1 | 12/2013 |

OTHER PUBLICATIONS

Extended European Search Report from European Patent Office for European Application No. 16184465.9, dated Mar. 23, 2017, 7 pgs.

Wu Chaozhong et al., "A Method of Vehicle Motion Prediction and Collision Risk Assessment with a Simulated Vehicular Cyber Physical System," Transportation Research, Part C, Emerging Technologies, vo. 47, Sep. 2, 2014, pp. 179-191, (13 pages).

English version of International Search Report for International Application No. PCT/CN2015/099727, dated Jul. 22, 2016, 4 pages.

Russian Search Report for Russian Application No. 2016115698/11, dated May 30, 2017, and English translation thereof, 4 pages.

Russian Office Action for Russian Application No. 2016115698/11, dated Jun. 15, 2017, and English translation thereof, 7 pages.

Communication from European Patent Office for European Application No. 16184465.9, dated May 15, 2018, 4 pages.

* cited by examiner

METHOD, APPARATUS AND STORAGE MEDIUM FOR PROVIDING COLLISION ALERT

CROSS-REFERENCE TO RELATED APPLICATION

This application is based on and claims priority to Chinese Patent Application No. 201510695152.2, filed Oct. 22, 2015, the entire contents of which are incorporated herein by reference.

TECHNICAL FIELD

The present disclosure relates to collision avoidance for a vehicle and, more particularly, to a method, an apparatus and a storage medium for providing a collision alert.

BACKGROUND

Automotive accidents, such as vehicle crashes, often involve vehicles traveling on curvy roads. When a vehicle travels around a curve, sound warnings, such as honking, are typically used to warn a driver of a vehicle traveling in the opposite direction, so as to avoid a possible collision.

SUMMARY

According to a first aspect of the present disclosure, there is provided a method for providing a collision alert, comprising: receiving position information of one or more vehicles; determining, based on the position information and road information, that a vehicle is about to encounter another vehicle at a curve; and providing the collision alert to the vehicle indicating a potential collision at the curve.

According to a second aspect of the present disclosure, there is provided an apparatus for providing a collision alert, comprising: a processor; and a memory for storing instructions executable by the processor. The processor is configured to perform: receiving position information of one or more vehicles; determining, based on the position information and road information, that a vehicle is about to encounter another vehicle at a curve; and providing the collision alert to the vehicle indicating a potential collision at the curve.

According to a third aspect of the present disclosure, there is provided a non-transitory computer-readable storage medium having stored therein instructions that, when executed by a processor of a device, cause the device to perform a method for providing a collision alert, the method comprising: receiving position information of one or more vehicles; determining, based on the position information and road information, that a vehicle is about to encounter another vehicle at a curve; and providing the collision alert to the vehicle indicating a potential collision at the curve.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
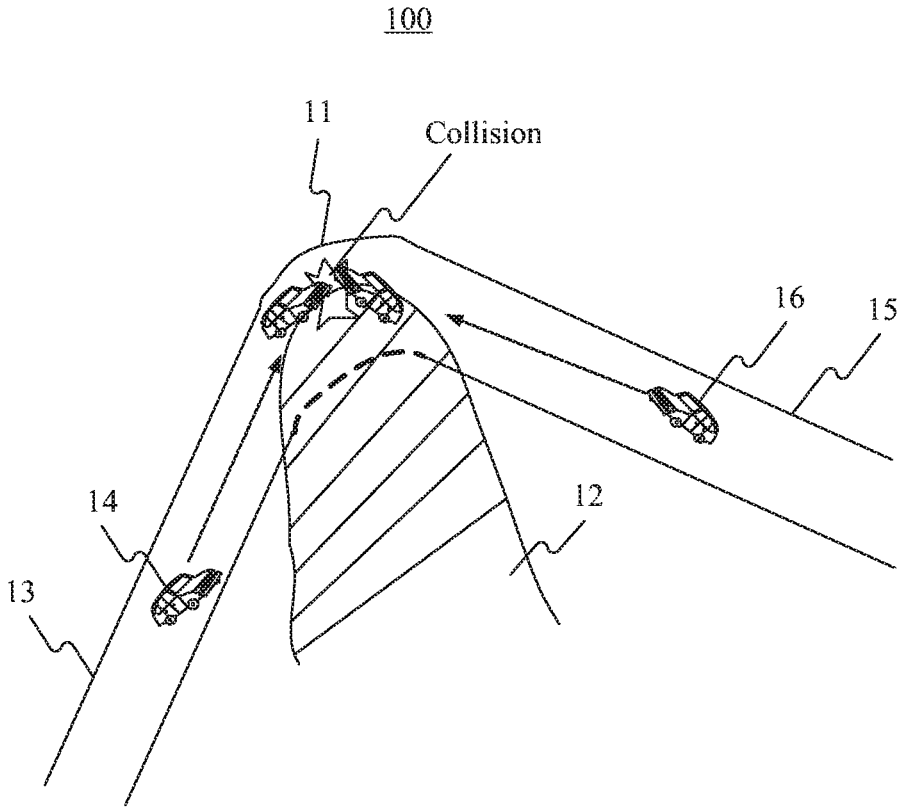
FIG. 1 is a schematic diagram illustrating an environment for a possible collision, according to an exemplary embodiment.

The risk of collision for vehicles traveling on a curvy road is high, causing life-threatening hazards to drivers and passengers. FIG. 1 is a schematic diagram illustrating an environment 100 for a potential collision, according to an exemplary embodiment. As shown in FIG. 1, a vehicle 14 is traveling on a lane 13 towards a curve 11, and a vehicle 16 is traveling on a lane 15 towards the curve 11 in the opposite direction, where a rock 12 is located near the curve 11. The drivers of the vehicle 14 and the vehicle 16 are unable to see each other due to the obstruction of the rock 12. As a result, a collision may occur when the vehicles 14 and 16 are both traveling on the curve 11. It can be seen that vehicles traveling at such type of curves are likely to collide.

Figure 2:
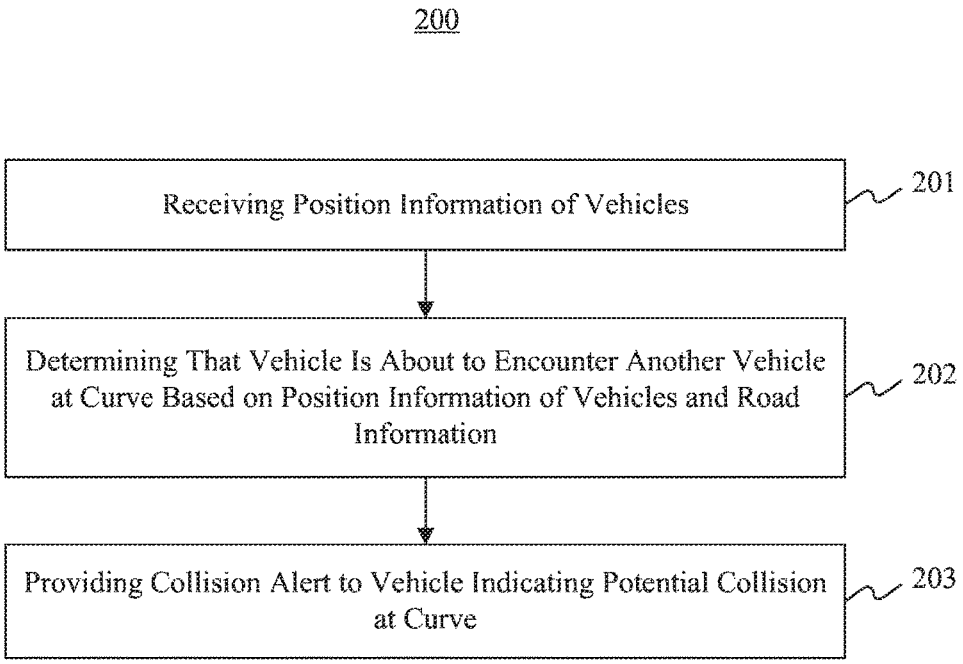
FIG. 2 is a flowchart of a method for providing a collision alert, according to an exemplary embodiment.

FIG. 2 is a flowchart of a method 200 for providing a collision alert, according to an exemplary embodiment. For example, the method 200 may be performed by an apparatus located inside a vehicle or a server. Referring to FIG. 2, the method 200 includes the following steps.

In step 201, the apparatus receives position information of vehicles. In some embodiments, the position information may include Global Positioning System (GPS) position coordinates of a vehicle at different time points. For example, a traveling vehicle is located at a position with coordinates z1 (e.g., latitude and longitude coordinates) at a time point t1 and at a position with coordinates z2 at a time point t2. In some embodiments, the position information may further include the travel speed of the vehicle.

In some embodiments, a vehicle may acquire the position information and transmit the position information to the apparatus for providing a collision alert. For example, the traveling vehicle may be provided with a vehicle navigation device. The navigation device can detect the coordinates of the vehicle based on a received GPS satellite signal and transmit the coordinates to the apparatus. In some implementations, the apparatus for providing the collision alert may be included in the navigation device of the vehicle, and the navigation device may acquire position information of the vehicle.

In step 202, the apparatus determines that a vehicle is about to encounter another vehicle at a curve based on the position information of the vehicles and road information. The road information may include information of whether the road the vehicle is traveling on is a one-way lane or a curve.

In some embodiments, a travel direction of a vehicle can be determined by the apparatus based on the position information of vehicles. For example, assuming a traveling vehicle is located at a position with coordinates z1 at a time point t1 and at a position with coordinates z2 at a time point t2, the travel direction of the vehicle can be determined based on z1 and z2. For example, it may be determined that the vehicle is traveling toward the curve based on z1 and z2. It may also be determined that a plurality of vehicles is traveling toward the curve based on the position information of the vehicles. In some embodiments, a collision site, indicative of an approximate location where vehicles are likely to collide with each other, can be determined according to travel speed of respective vehicles. For example, the travel speed may be calculated based on coordinates of the vehicle at different time points.

In step 203, the apparatus provides a collision alert to the vehicle indicating a potential collision at the curve.

In some embodiments, the apparatus for providing the collision alert is implemented in the navigation system of the vehicle, such that each individual vehicle may determine whether it is possible to collide with another vehicle. For example, when the vehicle determines that a collision is likely to occur, it may generate an alarm to alert the driver, such as playing a voice alarm "Please caution another vehicle is approaching in the opposite direction." In some embodiments, the vehicle may also transmit a collision alert to the other vehicle determined in step 202.

In some embodiments, the apparatus for providing the collision alert may be implemented in a server, and the position information of vehicles may be reported to the server by each individual vehicle. When the server determines that a vehicle is about to encounter another vehicle at a curve, the server may transmit a collision alert to each involved vehicle.

In the method 200, a potential collision may be determined based on the position information of vehicles and the road information, and a collision alert may be provided to the involved vehicle. In doing so, the driver of the vehicle can be warned in advance of a potential collision, so as to avoid the collision.

Figure 3:
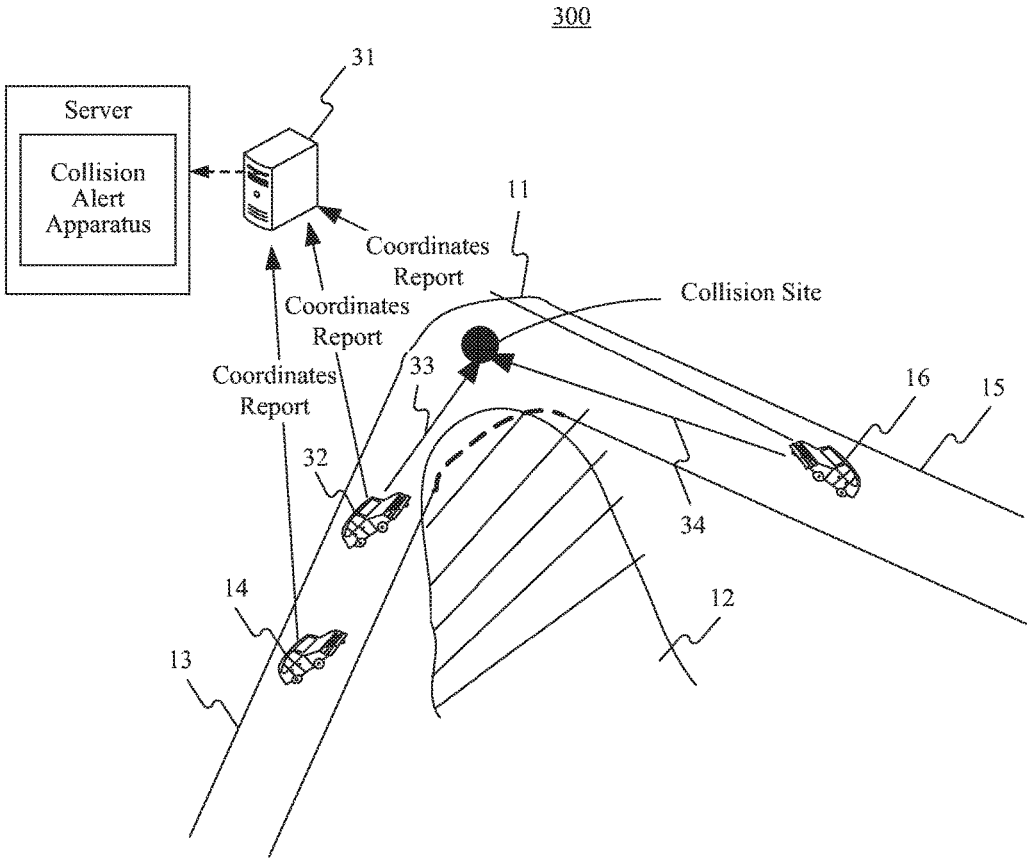
FIG. 3 is a schematic diagram illustrating a collision alert system, according to an exemplary embodiment.

FIG. 3 is a schematic diagram illustrating a collision alert system 300, according to an exemplary embodiment. In this embodiment, the apparatus for providing the collision alert is implemented in a server. Referring to FIG. 3, the collision alert system 300 includes a server 31 and vehicles 14, 16, and 32. As shown in FIG. 3, each vehicle reports coordinates of the vehicle to the server 31 for determining whether a collision is likely to occur.

Figure 4:
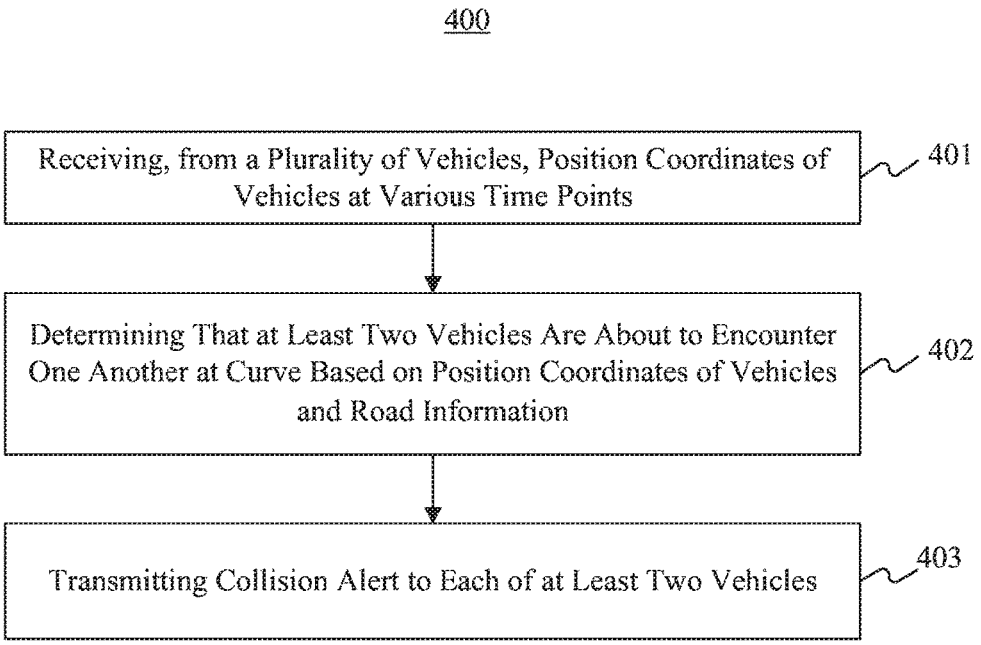
FIG. 4 is a flowchart of another method for providing a collision alert, according to an exemplary embodiment.

FIG. 4 is a flowchart of another method 400 for providing a collision alert. The method 400 may be performed by a server, such as the server 31 shown in FIG. 3. Referring to FIG. 4, the method 400 includes the following steps.

In step 401, the server receives, from a plurality of vehicles, position coordinates of vehicles at various time points. For example, referring to FIG. 3, each of vehicles 14, 16, and 32 reports its position coordinates to the server 31. The coordinates of the vehicle may be obtained through a GPS navigation system (e.g. in-vehicle or mobile phone navigation system). The coordinates of the vehicle may be reported to the server with other information, such as a travel speed of the vehicle. For example, the vehicle coordinates and travel speed may be periodically reported to the server by the vehicle via a Wide Area Network (WAN).

In step 402, the server determines that at least two vehicles are about to encounter one other at a curve based on the position coordinates of the vehicles and the road information.

For example, referring to FIG. 3, assuming that vehicles 32 and 16 are about to encounter each other at curve 11, the server may determine travel directions of both vehicles based on coordinates reported by vehicles 32 and 16 at different time points. As shown in FIG. 3, the travel directions of vehicles 32 and 16 are indicated by arrow 33 and arrow 34, respectively. The server may determine a distance between the vehicles according to the vehicle positions and the roads the vehicles are traveling on (e.g., the lane 13, the lane 15, and the curve 11). As shown in FIG. 3, the server may then determine a collision site. In some embodiments, the road information may be stored in the server in advance and may include map information of the area the vehicle is traveling in. For example, the road information may include a length and a width of a road where it travels, other road(s) intersecting with the road, locations of the curves, and surrounding terrain of the road, such as the location of an obstruction that may obstruct the driver's vision (e.g., a tree or a mountain), the existence of a sharp slope at the curve, or the like. The server may determine, based on the road information, that a collision alert is not required for certain curves. For example, the server may determine that an alert is not required for a curve providing an open view to drivers in the vehicles when the drivers' visions are not blocked by the curve.

In some embodiments, the server may provide a collision alert at curves causing hazards of accident, and information on those curves may be stored in the server in advance. For example, those hazard curves may be marked in advance in the road information that an alert is in need. After receiving the position information reported from a vehicle, the server may determine whether the curve approached by the vehicle is a hazard curve, and take no action if it is not a hazard curve. If the curve approached by the vehicle is a hazard curve, the server may determine whether there are vehicles traveling from the opposite direction toward the curve. In other embodiments, the server may not store any information of hazard curves and may determine whether a curve approached by the vehicle is a hazard curve according to the road information. For example, when the server determines that there is a large mountain at a curve, and that a driver's vision may be obstructed by the mountain according to the travel direction of the vehicle, the server may determine the curve to be a hazard curve, and then determine whether there are vehicles traveling from the opposite direction toward the curve.

In step 403, the server transmits a collision alert to each of the at least two vehicles that are about to encounter one another at the curve, such that each vehicle, upon receiving the collision alert, can generate an alarm alerting the potential collision.

For example, referring to FIG. 3, after determining the collision site of vehicles 32 and 16, the server determines that they are about to encounter each other at the curve 11.

A collision alert may be then transmitted from the server to both vehicles, for example, to a navigation system in the vehicles. The collision alert is configured to instruct the corresponding vehicle to generate an alarm to alert its driver. For example, upon receiving the collision alert, the navigation system may play a voice alarm "Please caution a car is approaching in the opposite direction" in the vehicle, so as to alert the driver to drive carefully to avoid an accident.

In the method 400, the server determines whether a vehicle is likely to encounter another vehicle at a curve based on position information reported by the vehicles, and the collision alert is transmitted to vehicles that are likely to be involved in a collision, such that accurate and efficient collision avoidance may be achieved.

Figure 5:
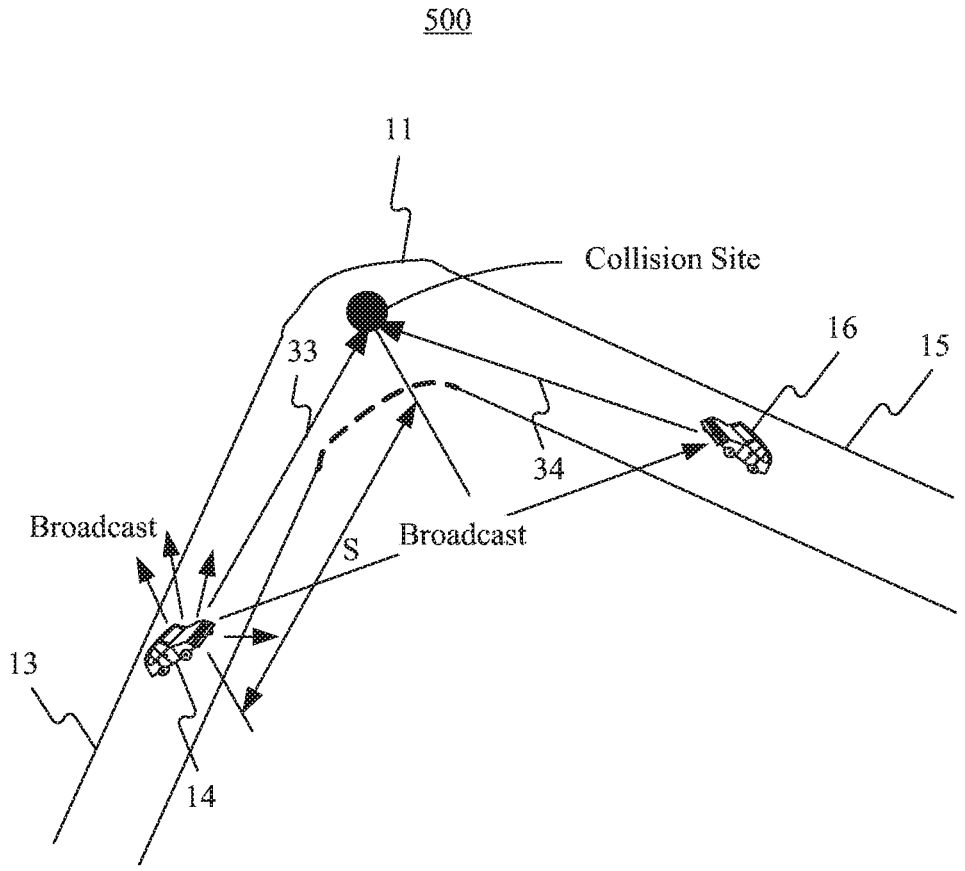
FIG. 5 is a schematic diagram illustrating another collision alert system, according to an exemplary embodiment.
Figure 6:
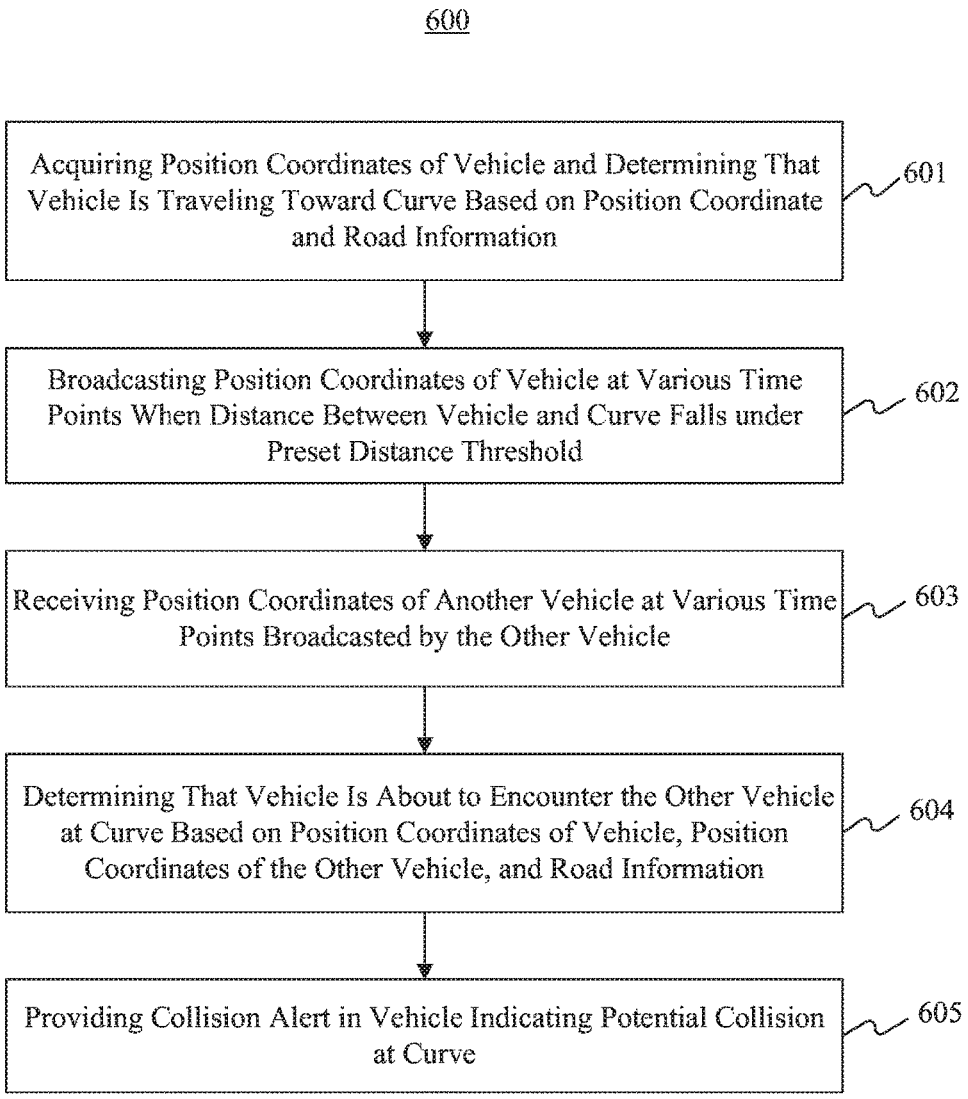
FIG. 6 is a flowchart of another method for providing a collision alert, according to an exemplary embodiment.

FIG. 5 is a schematic diagram illustrating another collision alert system 500, according to an exemplary embodiment. In this embodiment, the apparatus for providing the collision alert is implemented in a navigation device located inside a vehicle, such as an in-vehicle navigation device or a mobile terminal. Referring to FIG. 5, the collision alert system 500 includes vehicles 14 and 16, where each vehicle makes its own determination of whether a collision alert is required. As shown in FIG. 5, the vehicle 14 is traveling along a lane 13 and the vehicle 16 is traveling along a lane 15, where it is assumed the vehicles are about to encounter each other at the curve 11. FIG. 6 is a flowchart of another method 600 for providing a collision alert. The method 600 may be performed by an apparatus that is located inside a vehicle, such as the vehicle 14 or 16 shown in FIG. 5. For example, the apparatus may be included in a navigation device located within the vehicle. Referring to FIG. 6, the method 600 includes the following steps.

In step 601, the apparatus acquires position coordinates of the vehicle and determines that the vehicle is traveling toward a curve based on the position coordinates and road information.

For example, latitude and longitude coordinates of the vehicle 14 can be acquired by an in-vehicle navigation system inside the vehicle 14 based on received GPS signals, and the coordinates may be acquired periodically so as to determine the travel direction of the vehicle based on the coordinates at different time points. Combined with information of the road where the vehicle 14 travels, it can be determined that the vehicle 14 is about to approach the curve 11 when moving in the travel direction. An apparatus inside the vehicle 16, such as a navigation device, may also determine the travel direction of the vehicle 16. As shown in FIG. 5, the travel directions of the vehicle 14 and the vehicle 16 are denoted by an arrow 33 and an arrow 34, respectively.

In step 602, the apparatus broadcasts position coordinates of the vehicle at various time points when a distance between the vehicle and a curve falls under a preset distance threshold.

For example, positions of the vehicle can be determined by the navigation system of the vehicle, and it may not be necessary to broadcast the positions at all times. As illustrated in FIG. 5, assuming that the vehicle 14 moves along a direction indicated as the arrow 33 and is approaching the curve 11 and a distance S between the current position and the curve 11 is less than or equal to the preset threshold, the navigation system of vehicle 14 may start broadcasting of the position coordinates of the vehicle 14, for example, via Wi-Fi data broadcasting or Bluetooth™ channel.

In some embodiments, the broadcast function may be initiated manually by the driver when the vehicle approaches the curve. For example, when driving near a curve, the driver may determine the curve as a hazard curve by observing the surrounding terrain. Accordingly, the driver may trigger the vehicle to broadcast its position information by pressing a button manually.

In step 603, the apparatus receives position coordinates of another vehicle at various time points broadcasted by the other vehicle.

For example, the coordinates broadcasted by the vehicle 14 in step 602 may be received by the navigation system in the vehicle 16. Similarly, steps 601 and 602 can be performed by the vehicle 16, and the position coordinates broadcasted by the vehicle 16 can be received by the vehicle 14. Thus, each vehicle is able to receive position coordinates transmitted from another vehicle as well as acquiring its own position coordinates.

In step 604, the apparatus determines that the vehicle, at which the apparatus is located, is about to encounter the other vehicle at the curve based on position coordinates of the vehicle, position coordinates of the other vehicle, and the road information.

For example, referring to FIG. 5, a navigation device located inside the vehicle 14 may determine a travel direction of the vehicle 14 based on position coordinates of the vehicle 14, a travel direction of the vehicle 16 based on the received position coordinates of the vehicle 16, and travel speeds of both vehicles according to their position coordinates at various time points. Thus, the navigation device located inside the vehicle 14 may predict that the vehicle 14 is about to encounter the vehicle 16 at curve 11. Based on the road information, the navigation device may determine that trees and a mountain exist around the curve 11 blocking the driver's vision and that curve 11 is a hazard curve.

In step 605, the apparatus provides a collision alert in the vehicle indicating a potential collision at the curve.

For example, referring to FIG. 5, a voice alarm can be provided to the driver by the in-vehicle navigation device inside the vehicle 14. In some embodiments, the vehicle 14 may transmit an alert notification to the vehicle 16 indicating a potential collision at the curve. In other embodiments, the vehicle 14 may not transmit the notification to the vehicle 16, when an apparatus located inside the vehicle 16 can perform the method 600 on its own and determine that the vehicle 16 is about to encounter the vehicle 14 at the curve.

In the method 600, determination and alert of a potential collision are implemented individually by each vehicle without participation of a server, such that the method can be applied when the vehicle is not provided with a WAN function.

Figure 7:
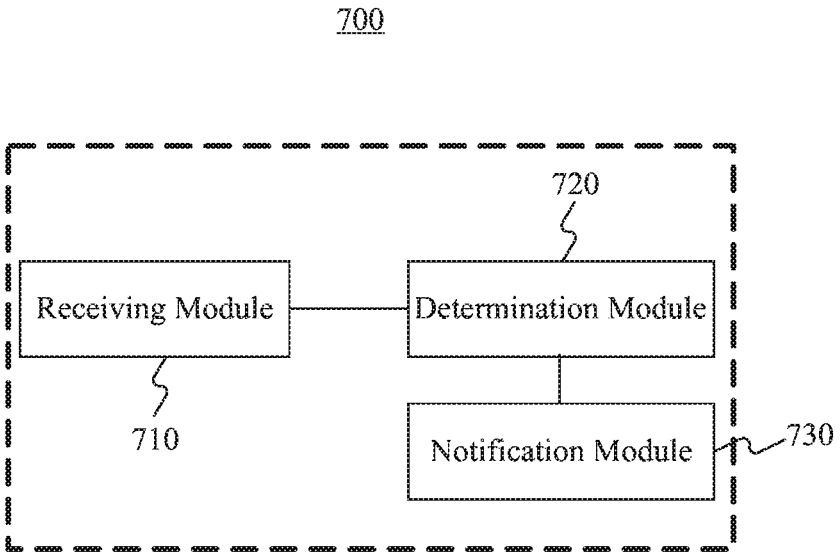
FIG. 7 is a block diagram of an apparatus for providing a collision alert, according to an exemplary embodiment.

FIG. 7 is a block diagram of an apparatus 700 for providing a collision alert, according to an exemplary embodiment. The apparatus 700 may be implemented in a server or in a navigation device located inside a vehicle. Referring to FIG. 7, the apparatus 700 includes a receiving module 710, a determination module 720, and a notification module 730.

The receiving module 710 is configured to receive position information of vehicles.

The determination module 720 is configured to determine that a vehicle about to encounter another vehicle at a curve according to the position information and road information.

The notification module 730 is configured to provide a collision alert to the vehicle.

In some embodiments, the apparatus 700 may be implemented as a part or all of a server, and the receiving module 710 is configured to receive position coordinates from a plurality of vehicles at various time points. Correspondingly, the notification module 730 is configured to transmit a collision alert to each vehicle that is about to encounter another vehicle at a curve, such that an alarm may be provided in each vehicle alerting a potential collision.

In other embodiments, the apparatus 700 may be implemented as a part or all of a navigation device in a vehicle. For example, the apparatus 700 may be implemented in an in-vehicle navigation device or a mobile terminal. The receiving module 71 is configured to acquire position coordinates of the vehicle at various time points from a navigation device and to receive position coordinates of another vehicle broadcasted from the other vehicle. The determination module 720 is configured to determine whether the vehicle is about to encounter the other vehicle at a curve according to the position coordinates of the vehicle, the position coordinates of the other vehicle, and the road information. The notification module 730 is configured to generate an alarm in the vehicle alerting a potential collision at the curve.

Figure 8:
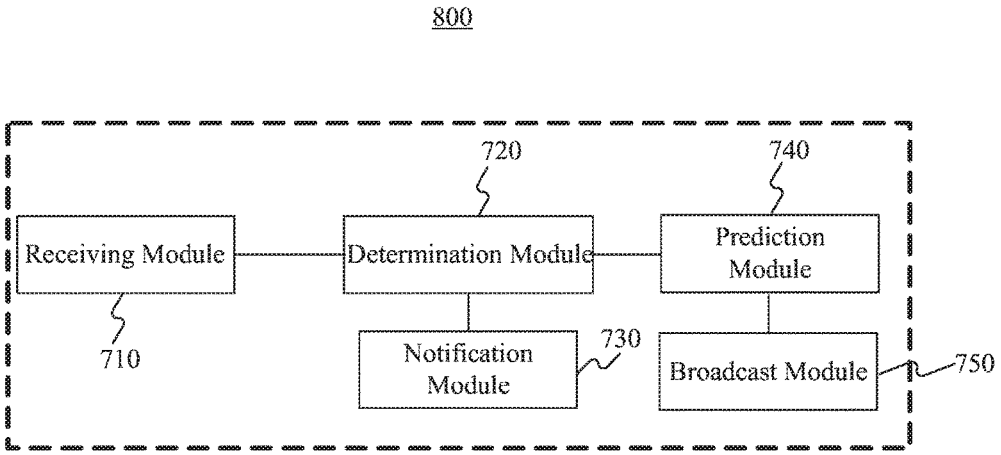
FIG. 8 is a block diagram of another apparatus providing a collision alert, according to an exemplary embodiment.

FIG. 8 is a block diagram of another apparatus 800 for providing a collision alert, according to an exemplary embodiment. The apparatus 800 may be implemented in a navigation device inside a vehicle, such as an in-vehicle navigation device or a mobile terminal. Referring to FIG. 8, in addition to the receiving module 710, determination module 720, and notification module 730 (FIG. 7), the apparatus 800 further includes a prediction module 740 and a broadcast module 750.

The prediction module 740 is configured to determine that the vehicle is traveling toward a curve based on the position coordinates of the vehicle acquired by the navigation device and the road information.

The broadcast module 750 is configured to broadcast the position coordinates of the vehicle at various time points when a distance between the vehicle and the curve falls under a preset distance threshold.

Figure 9:
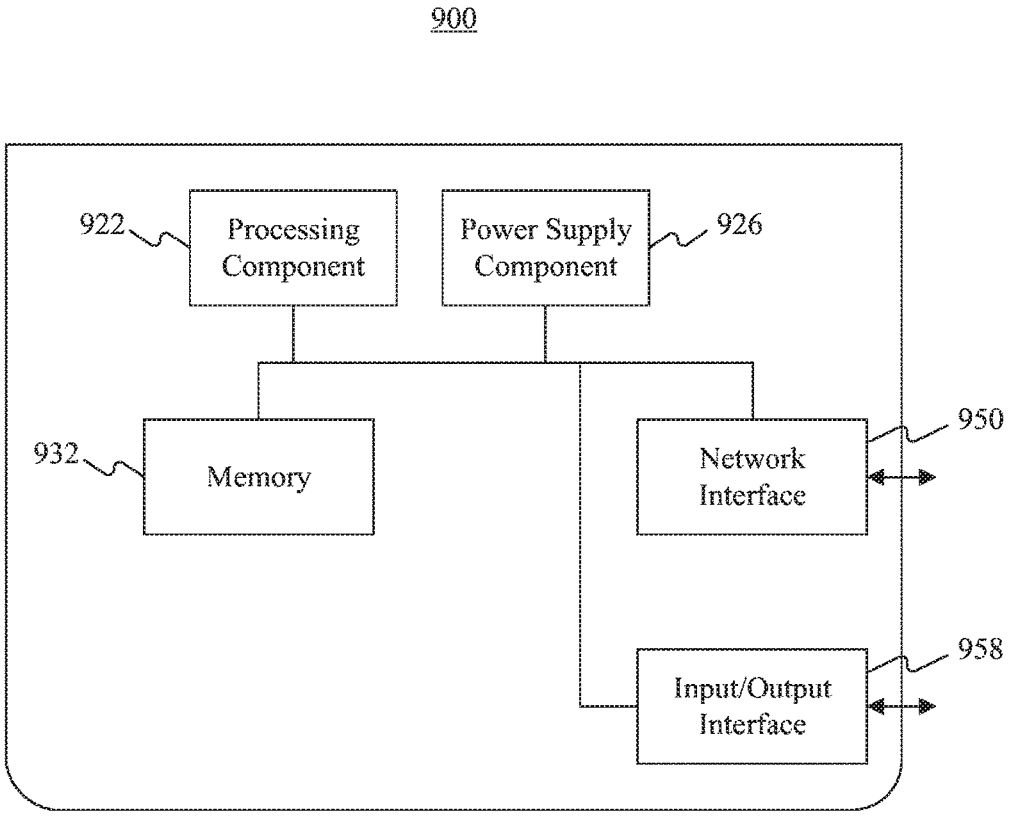
FIG. 9 is a block diagram of a device for providing a collision alert, according to an exemplary embodiment.

FIG. 9 is a block diagram of a device 900 for providing a collision alert, according to an exemplary embodiment. For example, the device 900 may be provided as a server. Referring to FIG. 9, the device 900 includes a processing component 922 which further includes one or more processors, and memory resources represented by a memory 932 for storing instructions, such as application programs, executable by the processing component 922. The application program stored in the memory 932 may include one or more modules, each of which corresponds to a set of instructions. In addition, the processing component 922 is configured to execute the instructions so as to perform the above described methods.

The device 900 further includes a power supply component 926 configured to perform power management of the device 900, a wired or wireless network interface 950 configured to connect the device 900 with a network, and an input/output (I/O) interface 958. The device 900 may be operated based on an operation system stored in the memory 932, such as Windows Server™, Mac OS X™, Unix™, Linux™, FreeBSD™ or the like.

Figure 10:
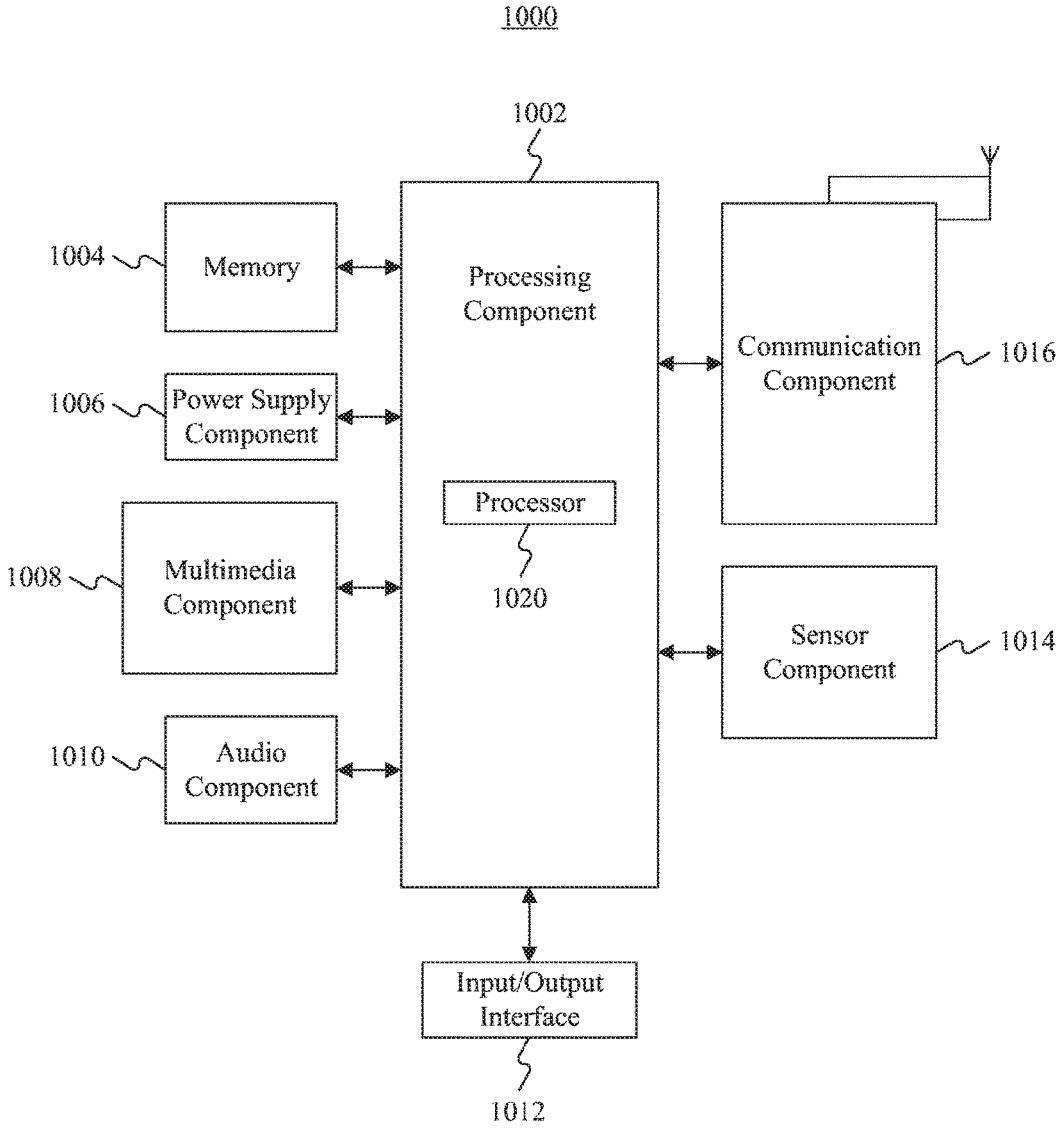
FIG. 10 is a block diagram of a mobile terminal, according to an exemplary embodiment.

FIG. 10 is a block diagram of a mobile terminal 1000 for providing a collision alert, according to an exemplary embodiment. For example, the mobile terminal 1000 may be a mobile phone, a computer, a digital broadcast terminal, a messaging device, a gaming console, a tablet device, a medical device, an exercise equipment, a personal digital assistant and the like. The mobile terminal 1000 may be used in a vehicle to perform the above described methods.

Referring to FIG. 10, the mobile terminal 1000 may include one or more of the following components: a processing component 1002, a memory 1004, a power supply component 1006, a multimedia component 1008, an audio component 1010, an input/output (I/O) interface 1012, a sensor component 1014, and a communication component 1016. The person skilled in the art should appreciate that the structure of the mobile terminal 1000 as shown in FIG. 10 does not intend to limit the mobile terminal 1000. The mobile terminal 1000 may include more or less components or combine some components or other different components.

The processing component 1002 typically controls overall operations of the mobile terminal 1000, such as the operations associated with display, telephone calls, data communications, camera operations, and recording operations. The processing component 1002 may include one or more processors 1020 to execute instructions to perform all or part of the steps in the above described methods. Moreover, the processing component 1002 may include one or more modules which facilitate the interaction between the processing component 1002 and other components. For instance, the processing component 1002 may include a multimedia module to facilitate the interaction between the multimedia component 1008 and the processing component 1002.

The memory 1004 is configured to store various types of data to support the operation of the mobile terminal 1000. Examples of such data include instructions for any applications or methods operated on the mobile terminal 1000, contact data, phonebook data, messages, images, video, etc. The memory 1004 is also configured to store programs and modules. The processing component 1002 performs various functions and data processing by operating programs and modules stored in the memory 1004. The memory 1004 may be implemented using any type of volatile or non-volatile memory mobile terminals, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power supply component 1006 is configured to provide power to various components of the mobile terminal 1000. The power supply component 1006 may include a power management system, one or more power sources, and any other components associated with the generation, management, and distribution of power in the mobile terminal 1000.

The multimedia component 1008 includes a screen providing an output interface between the mobile terminal 1000 and a user. In some embodiments, the screen may include a liquid crystal display (LCD) and/or a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1008 includes a front camera and/or a rear camera. The front camera and the rear camera may receive an external multimedia datum while the mobile terminal 1000 is in an operation mode, such as a photographing mode or a video mode. Each of the front camera and the rear camera may be a fixed optical lens system or have focus and optical zoom capability.

The audio component 1010 is configured to output and/or input audio signals. For example, the audio component 1010 includes a microphone configured to receive an external audio signal when the mobile terminal 1000 is in an operation mode, such as a call mode, a recording mode, and a voice recognition mode. The received audio signal may be further stored in the memory 1004 or transmitted via the communication component 1016. In some embodiments, the audio component 1010 further includes a speaker to output audio signals.

The I/O interface 1012 provides an interface between the processing component 1002 and peripheral interface modules, such as a keyboard, a click wheel, buttons, and the like. The buttons may include, but are not limited to, a home button, a volume button, a starting button, and a locking button.

The sensor component 1014 includes one or more sensors to provide status assessments of various aspects of the mobile terminal 1000. For instance, the sensor component 1014 may detect an on/off state of the mobile terminal 1000, relative positioning of components, e.g., the display and the keypad, of the mobile terminal 1000, a change in position of the mobile terminal 1000 or a component of the mobile terminal 1000, a presence or absence of user contact with the mobile terminal 1000, an orientation or an acceleration/deceleration of the mobile terminal 1000, and a change in temperature of the mobile terminal 1000. The sensor component 1014 may include a proximity sensor configured to detect the presence of nearby objects without any physical contact. The sensor component 1014 may also include a light sensor, such as a CMOS or CCD image sensor, for use in imaging applications. In some embodiments, the sensor component 1014 may also include an accelerometer sensor, a gyroscope sensor, a magnetic sensor, a pressure sensor, or a temperature sensor.

The communication component 1016 is configured to facilitate communication, wired or wirelessly, between the mobile terminal 1000 and other mobile terminals. The mobile terminal 1000 can access a wireless network based on a communication standard, such as WiFi, 2G, or 3G, or a combination thereof. In one exemplary embodiment, the communication component 1016 receives a broadcast signal or broadcast information from an external broadcast management system via a broadcast channel In one exemplary embodiment, the communication component 1016 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the mobile terminal 1000 may be implemented with one or more application specific integrated circuits (ASICs), digital signal processors (DSPs), digital signal processing mobile terminals (DSPDs), programmable logic mobile terminals (PLDs), field programmable gate arrays (FPGAs), controllers, micro-controllers, microprocessors, or other electronic components, for performing the above described methods.

The mobile terminal 1000 may further include a navigation device (not shown) configured to receive GPS satellite signals and determine position coordinates of the mobile terminal 1000.

In exemplary embodiments, there is also provided a non-transitory computer-readable storage medium including instructions, such as included in the memory 1004, executable by the processor 1020 in the mobile terminal 1000, for performing the above-described methods. For example, the non-transitory computer-readable storage medium may be a ROM, a RAM, a CD-ROM, a magnetic tape, a floppy disc, an optical data storage device, and the like.

It should be understood by those skilled in the art that the above described modules can each be implemented through hardware, or software, or a combination of hardware and software. One of ordinary skill in the art will also understand that multiple ones of the above described modules may be combined as one module, and each of the above described modules may be further divided into a plurality of sub-modules.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method for providing a collision alert, comprising:

receiving position information of one or more vehicles;

determining, based on the position information and road information, that a vehicle is about to encounter another vehicle at a curve, wherein the position information includes position coordinates of the vehicle;

determining that the vehicle is traveling toward the curve according to the position coordinates of the vehicle and the road information;

broadcasting the position coordinates of the vehicle when a distance between the vehicle and the curve falls under a preset distance threshold; and providing the collision alert to the vehicle indicating a potential collision at the curve.

2. The method of claim 1, wherein the position information is received at a server, the position information includes position coordinates of the vehicles at a plurality of time points, the method further comprising:

transmitting another collision alert to the other vehicle indicating the potential collision at the curve.

3. The method of claim 1, wherein the position information includes position coordinates of the other vehicle at a plurality of time points, and the position coordinates of the other vehicle is broadcasted from the other vehicle and received at the vehicle.

4. The method of claim 3, wherein a navigation device is located inside the vehicle for receiving the position information, and the navigation device includes an in-vehicle navigation device or a mobile terminal.

5. The method of claim 1, further comprising:

when it is determined that the vehicle is about to encounter the other vehicle at the curve, sending a notification to the other vehicle indicating the potential collision at the curve.

6. The method of claim 1, further comprising:

determining whether the curve is a hazard curve based on the road information; and if the curve is determined to be a hazard curve, providing the collision alert to the vehicle.

7. The method of claim 1, wherein the road information includes a surrounding terrain of a road the vehicle is traveling on.

8. The method of claim 1, wherein the position information includes a travel speed of each of the one or more vehicles.

9. An apparatus for providing a collision alert, comprising:

a processor; and a memory for storing instructions executable by the processor;

wherein the processor is configured to perform:

receiving position information of one or more vehicles;

determining, based on the position information and road information, that a vehicle is about to encounter another vehicle at a curve, wherein the position information includes position coordinates of the vehicle;

determining that the vehicle is traveling toward the curve according to the position coordinates of the vehicle and the road information;

broadcasting the position coordinates of the vehicle when a distance between the vehicle and the curve falls under a preset distance threshold; and providing the collision alert to the vehicle indicating a potential collision at the curve.

10. The apparatus of claim 9, wherein the position information is received at a server, the position information includes position coordinates of the vehicles at a plurality of time points, and wherein the processor is further configured to perform:

transmitting another collision alert to the other vehicle indicating the potential collision at the curve.

11. The apparatus of claim 9, wherein the apparatus is included in a navigation device located inside the vehicle, the position information includes position coordinates of the other vehicle at a plurality of time points, and the position coordinates of the other vehicle is broadcasted from the other vehicle and received at the vehicle.

12. The apparatus of claim 11, wherein the navigation device includes an in-vehicle navigation device or a mobile terminal.

13. The apparatus of claim 9, wherein the processor is further configured to perform:

when it is determined that the vehicle is about to encounter the other vehicle at the curve, sending a notification to the other vehicle indicating the potential collision at the curve.

14. The apparatus of claim 9, wherein the processor is further configured to perform:

determining whether the curve is a hazard curve based on the road information; and if the curve is determined to be a hazard curve, providing the collision alert to the vehicle.

15. The apparatus of claim 9, wherein the road information includes a surrounding terrain of a road the vehicle is traveling on.

16. The apparatus of claim 9, wherein the position information includes a travel speed of each of the one or more vehicles.

17. A non-transitory computer-readable storage medium having stored therein instructions that, when executed by a processor of a device, cause the device to perform a method for providing a collision alert, the method comprising:

receiving position information of one or more vehicles;

determining, based on the position information and road information, that a vehicle is about to encounter another vehicle at a curve, wherein the position information includes position coordinates of the vehicle;

determining that the vehicle is traveling toward the curve according to the position coordinates of the vehicle and the road information;

broadcasting the position coordinates of the vehicle when a distance between the vehicle and the curve falls under a preset distance threshold; and providing the collision alert to the vehicle indicating a potential collision at the curve.

* * * * *